US005855079A

United States Patent [19]

Herbert

[11] Patent Number: 5,855,079

[45] Date of Patent: Jan. 5, 1999

[54] MULTI-SKINNED BOOTS

[75] Inventor: John Herbert, St Ives, Australia

[73] Assignee: Nina Meling, Lindfield, Australia

[21] Appl. No.: 894,429

[22] PCT Filed: Dec. 19, 1995

[86] PCT No.: PCT/AU95/00865

§ 371 Date: Aug. 19, 1997

§ 102(e) Date: Aug. 19, 1997

[87] PCT Pub. No.: WO96/19127

PCT Pub. Date: Jun. 27, 1996

[30] Foreign Application Priority Data

Dec. 19, 1994 [AU] Australia ..... PN 0098

[51] Int. Cl.[6] ..... A43B 5/04

[52] U.S. Cl. ..... 36/88; 36/10; 36/55; 36/117.6

[58] Field of Search ..... 36/88, 10, 55, 36/71, 69, 117.6

[56] References Cited

U.S. PATENT DOCUMENTS

| | | | |
|---|---|---|---|
| 3,394,473 | 7/1968 | Romen | 36/10 |
| 4,706,316 | 11/1987 | Tanzi | 36/55 |
| 5,068,985 | 12/1991 | Pozzebon | 36/55 |
| 5,509,217 | 4/1996 | Condini | 36/10 |
| 5,526,587 | 6/1996 | Sartor | 36/10 |
| 5,682,686 | 11/1997 | Condini | 36/10 |

FOREIGN PATENT DOCUMENTS

| | | |
|---|---|---|
| 0651953 A1 | 10/1994 | European Pat. Off. . |
| 0657116 A1 | 11/1994 | European Pat. Off. . |
| 27 11 506 | 5/1980 | Germany . |
| 3822113 C2 | 2/1995 | Germany . |

*Primary Examiner*—M. D. Patterson

*Attorney, Agent, or Firm*—Cohen, Pontani, Lieberman & Pavane

[57] ABSTRACT

A three piece boot comprising a sock-like inner member, a structural protective cage intermediate member incorporating rigid toe, arch and heel protection and an outer member having a sole with flexible upper with little form rigidity; the inner sock-like member having resiliently deformable foamed material bonded to the toe, sole and heel portions in order to provide a comfort liner and in order to facilitate the substitution of different inner sock-like members to accommodate a range of foot sizes within a single protective cage and flexible outer member size; a locking device to lock the protective cage to the outer member and a releasable locking device to lock the inner sock-like member into the protective cage.

16 Claims, 5 Drawing Sheets

MULTI-SKINNED BOOTS

Figure 1:
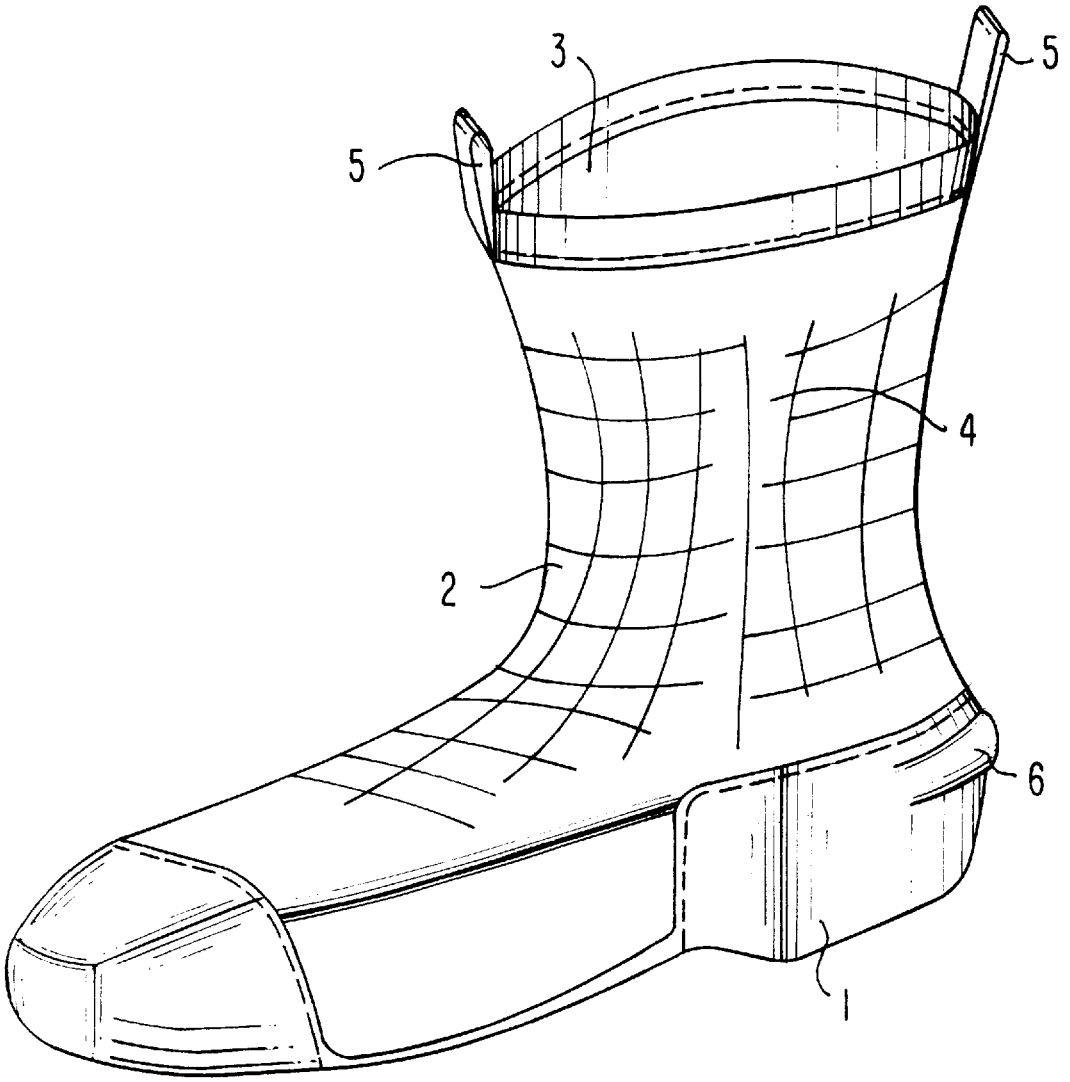
Figure 2:
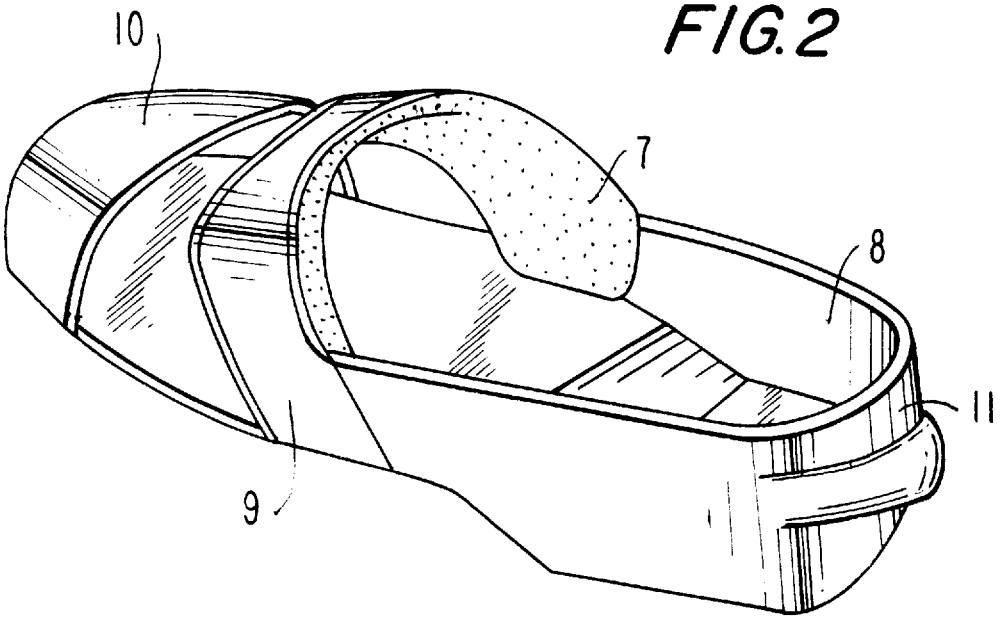
Figure 3:
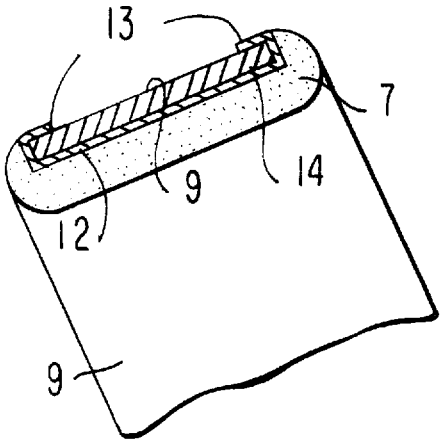
Figure 4:
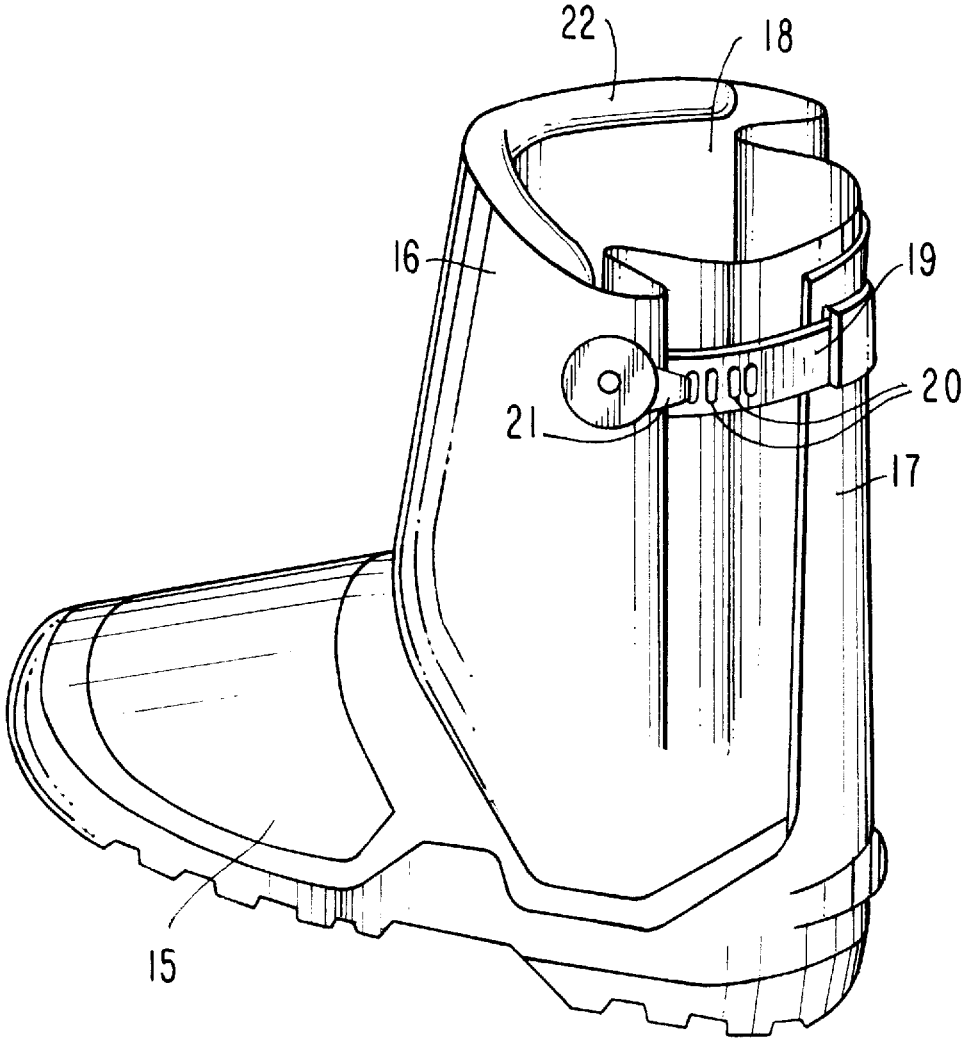
Figure 5:
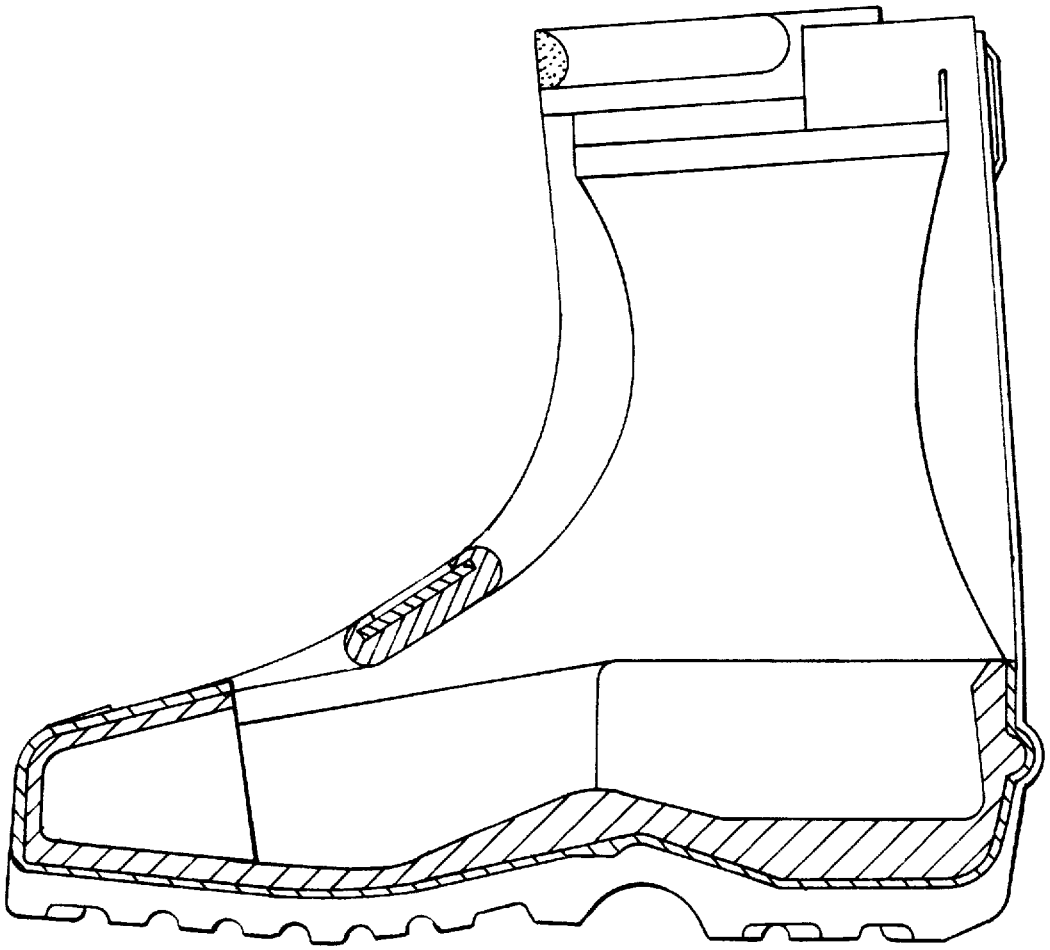
Figure 6:
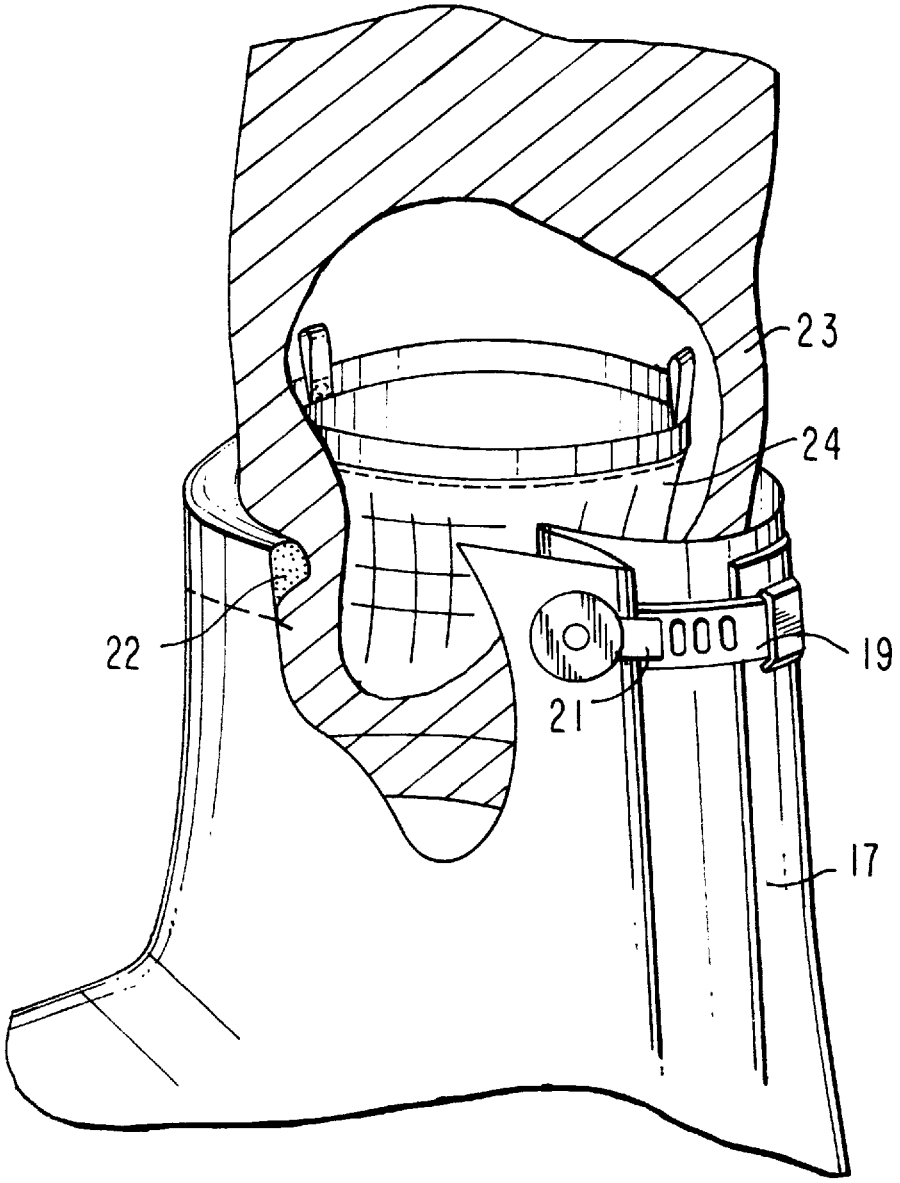

The present invention relates to boots of the type having a separate and distinguishable inner and outer boot with a protective cage there between. For a number of years it has been common to provide footwear with an inner and an outer boot in order that precise fitting may be achieved by varying the size of the inner boot whilst maintaining a limited range of outer boot sizes in stock. The outer boot may additionally be tailored to specific uses without varying the design of the inner boot. This method of construction of boots has for some years been quite popular in relation to ski boots and in-line skates. Protective footwear has also utilised such a system with a protective cage designed to protect one or more of the wearer's arch, toes or heel interposed between the inner and outer boot. The lastmentioned type of boot can use a very flexible outer boot upper in order to render it waterproof without adding significantly to the weight of the boot although such boots often have cumbersome arrangements for tightening the upper boot around the wearer's shin.

It is accordingly an object of the present invention to disclose improved systems for manufacturing footwear of the type described or at least to provide the market with an alternative.

According to one aspect of the present invention there is disclosed an inner boot having a sole, heel and toe portion formed of resiliently deformable material bonded or otherwise affixed to a sock-like upper; the upper being formed of material capable of stretching in a lateral plane to an extent necessary to permit passing of a foot therethrough whilst being capable of contracting back to a snug position about the wearer's lower calf and shin; the upper being relatively inextensible in a vertical direction to allow it to be pulled vertically without significant stretching during the introduction of the wearer's foot through the upper opening; there being an external lateral protrusion from the resiliently deformable heel portion of the inner boot adapted to co-operate with an indent in the outer boot in order to prevent relative movement between the inner and outer boot.

According to another aspect of the present invention there is disclosed a sizing and comfort spacer adapted for affixation about the inside of the arch protecting portion of a protective cage.

According to a further aspect of the present invention there is disclosed an outer boot having an upper portion adapted to fit about the lower shin and calf of a wearer constructed from thin fabric having little form memory; the rear portion of the upper of such outer boot being reinforced by resiliently deformable material in the area of the Achilles tendon and extending to a position adjacent the upper extremity of the boot upper; the upper area of such resiliently deformable reinforcement carrying fastening means adapted to releasably engage complementary fastening means adjacent the top of each side of the material comprising the upper extremity of the boot; the mating of the fastening means being adapted to secure the material comprising the upper extremity of the boot snugly about the wearer's calf and shin whilst the undoing of such fastenings permits opening of the upper extremity of the outer boot so as to facilitate removal or introduction of the wearer's foot.

A number of aspects of the present invention will be described with reference to the accompanying drawings in which:

FIG. I is a perspective view of an inner boot constructed in accordance with the present invention;

FIG. II is a perspective view of a protective cage in accordance with the present invention;

FIG. III is a section through the arch protector of the protective cage of FIG. II;

FIG. IV is a perspective view of an outer boot in accordance with the present invention;

FIG. V is a section through an assembled inner and outer boot combination in accordance with the present invention; and FIG. VI is a schematic view of the upper portion of an inner and outer boot in accordance with the present invention.

According to the embodiment of FIG. I there is disclosed an inner boot having a toe, sole and heel portion 1 formed in a unitary manner from foamed urethane. Foamed polyurethanes and EVA/polypropylene mixes also been tried with success. The material is ideally a foamed cellular product which has impact and cushioning capabilities.

The unitary toe, sole and heel portion 1 is bonded to a knitted sock-like member 2 which material allows "breathing" of the wearer's foot to the extent that it is capable of passing air at least in one direction. The knitted nature of the sock-like portion 2 further facilitates the manufacture of the product so that it is relatively inextensible in a vertical direction and yet relatively extensible in the horizontal direction. The horizontal extensibility is necessary in order that a wearer's foot may pass down through opening 3 into the lower portion of the boot whilst expanding the neck portion 4 of the sock-like member. The vertical inextensibility facilitates the wearer pulling on the inner boot by utilising tabs 5 without unduly distorting the inner boot during such process.

The toe, sole and heel portion 1 may be attached to the sock-like upper 2 by any appropriate means such as stitching, welding or bonding with appropriate glues. The top of the sock-like upper adjacent opening 3 is reinforced around its peripheral portions in order to better define opening 3 and guard against premature wear. The inner boot may be partially or wholly formed of fabrics or materials incorporating activated carbon to help control undesirable foot odours.

It will be appreciated that the thickness of toe, sole and heel portion 1 may vary in order that the inner boot may be a tight fit within the outer boot. In this manner a number of inner boots may be provided in order to accommodate varying foot sizes without varying the size of the outer boot. In order to prevent relative movement between the inner and outer boot when the boot is in use lateral protrusion 6 is provided extending laterally and rearwardly in an outward direction from the heel portion of toe, sole and heel unit 1. This lateral protrusion is adapted to "key" into a corresponding indent in the outer boot in a manner best viewed in FIG. V.

The upper of the flexible outer member may be fabricated from a material having little or no memory or form stability as the complete boot will derive its form stability from the protective cage.

In an embodiment where the upper of the flexible outer member of the boot is fabricated from a material having little form stability as abovementioned it has been found desirable to include a strip of relatively rigid material in the outer member extending from the heel thereof up to an area adjacent the top of the boot along the line of the Achilles tendon.

Turning now to FIG. II a second aspect of the present invention will be described being the sizing and comfort spacer 7 which is adapted to fit onto protective cage 8 and more particularly onto the arch protector 9 of protective cage 8. The protective cage 8 is intended to be interposed between an inner and outer boot in a manner best viewed from FIG. V. The protective cage depicted contains a toe protector portion 10 the arch protector 9 and a heel protector portion 11. The protective cage may be fabricated from any appropriate material although in this instance it is fabricated from "Zytel Supertough" TM nylon. Other impact resistant toughened thermoplastic resins may however be just as appropriate. This protective cage 8 may be locked into the outer member of the boot by way of a bulbous protrusion extending rearwardly from the heel of the protective cage adapted to snap into a complementary bulbous cavity in the heel of the outer member. This configuration may be similar to the configuration previously hereinbefore described with reference to the keying of the inner boot to the outer boot and indeed the same configuration may be utilised in order to key both the inner boot to the protective cage and the protective cage to the outer boot. The keying of all three components as lastmentioned is best viewed in FIG. V hereof The locking or "keying" of the protective cage to the outer member of the boot may be either releasable or nonreleasable as in many instances it will never be necessary to remove the cage from the outer member of the boot.

It has been found that the incorporation of an arch protector in a boot of the type described is difficult having regard to the fact that the insteps and hence the height of the foot adjacent its mid-length varies greatly from wearer to wearer. It is also the case that the arch protector 9 must be at a height slightly greater than that of the corresponding portion of the wearer's foot in order to facilitate entry and exit of the foot from the cage. In this regard the height and placement of the arch protector has been found to be one of the most critical dimensions associated with the protective cage and one which is not necessarily related to the length or width of foot being accommodated. In order therefore to ensure the comfort of the wearer as well as a snug fit of the protective cage about the wearer's foot it has been discovered that a "snap-on" sizing and comfort spacer is desirable. The spacer not only prevents chafing of the wearer's foot by the arch protector but the resiliently deformable padding material from which its internally facing surfaces are constructed ensures a relatively snug and comfortable fit about the wearer's foot. Various thicknesses of sizing and comfort spacers may therefore be held in stock to ensure a well tailored fit in every instance.

As will best be viewed from the section comprising FIG. III one embodiment of the sizing and comfort spacer may comprise a substantially 'C' section frame portion 12 fabricated from a relatively stiff plastic material having flanges 13 adapted to clip around arch protector 9. It is this frame 12 to which the required thickness of padded sizing material 14 may be affixed.

According to a further aspect of the present invention there is disclosed a closing mechanism for footwear in accordance with the present invention having an outer boot with a flexible upper about the lower shin and calf of the wearer.

According to the embodiment of FIG. IV there is disclosed an outer boot 15 having an upper constructed of relatively flexible thin waterproof material 16 with little form memory. This material 16 is reinforced in the area of the Achilles tendon by stiffening member 17 which may itself be formed from resiliently deformable material such as rubber but does possess some memory so as to cause the upper portion of the boot adjacent opening 18 to stand upright.

Stiffening member 17 is adapted to captivate strap 19 provided on either side of stiffening member 17 with a series of slots 20. It will be observed that slots 20 are adapted to accommodate hook-like members 21 on either side of the material comprising the upper portion of the boot adjacent the upper opening 18. Strap 20 may be fabricated from an elastic type material such as rubber. It will be appreciated that hook-like members 21 on either side of the boot may be placed into appropriate slots 20 in order to tension the material 16 comprising the upper of the boot about the wearer's calf and shin into a comfortable sealing relationship therewith. Resiliently deformable padding 22 may additionally be provided around at least the front portion of opening 18 in order that it may bear against the wearer's pants or shin thereby effecting a dust and water seal and promoting comfort.

The closing arrangement depicted in FIG. IV is further clarified in FIG. VI in which the boot is shown in the closed position about the pants 23 of a wearer with the inner boot 24 being shown in a schematic manner (not necessarily to scale) within the outer boot and pants.

It will be appreciated that many other embodiments of the present invention may be devised without departing from the scope and intendment thereof and in particular the materials of construction may be varied from those nominated in the embodiments described above.

The claims defining the invention are as follows:

1. A boot comprising an inner member and an outer member configured for releasable securement about said inner member, said outer member including a sole, a flexible upper, and a protective cage incorporating a substantially rigid toe portion, an arch portion and a heel portion, said arch portion and said heel portion of said cage being adapted to be interposed between said inner member and said outer member, the inner member having an upper and a sole, a heel and a toe portion, said sole, heal and toe portions of said inner member being formed from resiliently deformable material which is affixed to said inner member upper, said inner member upper having a longitudinal axis and being formed of material capable of stretching in a lateral plane to an extent necessary to permit passing of a foot therethrough while being relatively inextensible along its longitudinal axis in order to allow said inner member upper to be pulled vertically without significant stretching during introduction of the foot through said inner member; releasable locking means for locking said inner member to the protective cage; and locking means for locking said protective cage to said outer member.

2. A boot in accordance with claim 1 hereof wherein the inner member incorporates a fabric including activated carbon at at least the sole area between the wearer's foot and the resiliently deformable material.

3. A boot in accordance with claim 1 hereof wherein the upper of the flexible outer member is fabricated from a material sufficiently flexible so that said boot has a form defined by a shape of said protective cage.

4. A boot in accordance with claim 1 hereof wherein the upper of the flexible outer member is fabricated from a material sufficiently flexible so that the upper of the outer member has a form defined by a strip of relatively rigid material which extends from the heel portion of said protective cage to an area adjacent a top portion of said boot, said strip being disposed on said boot in substantial alignment with a location of an Achilles tendon of a user's foot when the foot is placed in said boot.

5. A boot in accordance with claim 1 hereof wherein the arch portion of the protective cage is configured for receiving a padded sizing member for facilitating sizing of the protective cage to an individual foot and to enhance comfort.

6. A boot in accordance with claim 1 hereof wherein the arch portion of the protective cage is configured for receiving a padded sizing member for facilitating sizing of the protective cage to an individual foot and to enhance comfort, the sizing member comprising a relatively rigid 'C' section frame portion configured for releasable attachment about an inside of the arch portion of said cage the 'C' section frame portion being provided with padded sizing and comfort material on an internally facing surface.

7. A boot in accordance with claim 1 hereof wherein the resiliently deformable material is bonded to the inner member and comprises an elastomeric foam.

8. A boot in accordance with claim 1 hereof wherein the resiliently deformable material is bonded to the inner member and comprises one of a polyurethane based foam and a polyester based foam to assist comfort and sizing of the composite boot to a particular foot.

9. A boot in accordance with claim 1 hereof wherein the sole, heel and toe portions of the inner member are unitary.

10. A boot in accordance with claim 1 hereof wherein the releasable locking means adapted to lock the inner member to the protective cage is a bulbous rearward projection from the heel portion of the inner member adapted to releasably snap into a complementary void at the heel portion of the protective cage.

11. A boot in accordance with claim 1 hereof wherein the releasable locking means adapted to lock the inner member to the protective cage is a bulbous rearward projection from the heel portion of the inner member adapted to releasably attach to a complementary void at the heel portion of the protective cage, said bulbous rearward projection from the heel portion of the inner member being fabricated from the same resiliently deformable material as the heel portion of the inner member.

12. A boot in accordance with claim 1 hereof further comprising releasable locking means between the protective cage and the outer member comprising a bulbous protrusion extending rearwardly from the heel portion of the protective cage adapted to snap into a complementary bulbous concavity in the heel portion of the outer.

13. A boot in accordance with claim 1 hereof further comprising a locking means between the protective cage and the outer member comprising a bulbous protrusion extending rearwardly from the heel of the protective cage adapted to snap into a complementary bulbous concavity in the heel of the outer member.

14. A boot in accordance with claim 1 wherein the upper of the inner member of the boot is knitted.

15. A boot in accordance with claim 1 hereof wherein at least part of the upper of the inner member of the boot is constructed of a breathable material which is capable of passing air in at least one direction.

16. A boot in accordance with claim 1 hereof wherein at least part of the upper of the inner member of the boot is constructed of a breathable material which is capable of passing moisture away from the foot.

* * * * *